US008406449B2

(12) United States Patent
Wegener

(10) Patent No.: US 8,406,449 B2
(45) Date of Patent: Mar. 26, 2013

(54) PORTABLE AUDIO AMPLIFIER WITH INTERCHANGEABLE HOUSING AND STORAGE COMPARTMENT

(75) Inventor: Adam Stephen Wegener, Sunnyvale, CA (US)

(73) Assignee: Trash Amps LLC, Sunnyvale, CA (US)

( * ) Notice: Subject to any disclaimer, the term of this patent is extended or adjusted under 35 U.S.C. 154(b) by 233 days.

(21) Appl. No.: 12/891,805

(22) Filed: Sep. 28, 2010

(65) Prior Publication Data

US 2012/0076337 A1 Mar. 29, 2012

(51) Int. Cl.
*H04R 1/02* (2006.01)

(52) U.S. Cl. ..... 381/388; 381/386

(58) Field of Classification Search ..... 381/189, 381/386, 388; 379/428.01, 429, 430, 433.02, 379/433.11, 437

See application file for complete search history.

(56) References Cited

U.S. PATENT DOCUMENTS

| | | | | |
|---|---|---|---|---|
| 4,677,654 | A * | 6/1987 | Lagin et al. | 379/437 |
| 5,420,739 | A | 5/1995 | Yokozawa | |
| 5,979,175 | A | 11/1999 | Ellison | |
| 6,011,686 | A | 1/2000 | Grasso | |
| 6,616,080 | B1 | 9/2003 | Edwards | |
| 6,698,560 | B2 | 3/2004 | Reardon | |
| 6,957,089 | B2 * | 10/2005 | Oh et al. | 379/428.01 |
| 7,197,348 | B2 | 3/2007 | Pan | |
| 7,206,422 | B2 * | 4/2007 | Akens et al. | 381/189 |
| 7,372,974 | B2 | 5/2008 | Yanagishita | |
| 2007/0099680 | A1 | 5/2007 | Kielland | |

OTHER PUBLICATIONS

Author: Chris Davies, Title: Dean Brown Audio Can helps your beans to sing, Source: SlashGear.com, Product Title: Dean Brown Audio Can, Date Published: Dec. 9, 2009, URL visited Oct. 4, 2012: http://www.slashgear.com/dean-brown-audio-can-helps-your-beans-to-sing-0965563/.

Product Title: Cactus Tube Amps Keg Blaster, Source: http://cactusampworks.com/, URL visited Oct. 11, 2012: http://cactusampworks.com/kegblaster.html.

Product Title: Mai Coffee Cup Portable Speaker by Cyanics, Source: Amazon.com, Date First available on Amazon: Jan. 21, 2010, URL visited Oct. 11, 2012: http://www.amazon.com/Coffee-Portable-Speaker-Players-Cyanics/dp/B0035CWB91/ref=sr_1_2?s=electronics&ie=UTF8&qid=1349978279&sr=1-2&keywords=mai+coffee.

Product Title: iLuv iSP110 3.5mm Aux Portable Speaker Case, Source: Amazon.com, Date First available on Amazon: Nov. 1, 2009, URL visited Oct. 11, 2012: http://www.amazon.com/iLuv-iSP110-3-5mm-Portable-Speaker/dp1B002MAPSDA/ref=sr_1_1?ie=UTF8&gid=1349977748&sr=8-1&keywords=iluv+isp110.

(Continued)

*Primary Examiner* — Brian Ensey

(57) ABSTRACT

A portable audio amplifier for a portable audio device or musical instrument that includes an internal housing and an exchangeable external housing and exchangeable cover, as well as a storage compartment is described. The storage compartment, which is contained in the internal housing, may contain a cord and other audio accessories such as picks, batteries, adapters, or personal items. The storage compartment can be opened through various methods, including translation, swiveling, pivoting, or sliding of a cover. The amplifier's external housing and/or cover may be customized by the user after purchase using exchangeable elements. Exchangeable external housing options, which act like a skin for the amplifier, include both manufactured housings (designed specifically as an external housing for the audio amplifier) and repurposed housings (designed for a primary purpose other than audio amplification). An adaptive structure may be used to adapt the dimensions of the internal housing to a larger, external housing.

27 Claims, 13 Drawing Sheets

OTHER PUBLICATIONS

Author: Addydugdale, Title: Logitech G9 Mouse Has Interchangeable Grip, Source: Gizmodo.com, Product Title: Logitech G9 Mouse, Date Published: Aug. 1, 2007, URL visited Oct. 4, 2012: http://gizmodo.com/284716/logitech-g9-mouse-has-interchangeable-grip-will-make-david-hasselhoff-happy.

Product Title: OrigAudio Fold n Play Recycled Speakers, Source: Amazon.com, Date First available on Amazon: May 3, 2010, URL visited Oct. 11, 2012: http://www.amazon.com/OrigAudio-Recycled-Speakers-iPhone-Standard/dp/B003BIFLNE/ref=pd_sim_sbs_hg_5.

Product Title: OrigAudio Rock-IT 2.0 Portable Vibration Speaker, Source: Amazon.com, Date First available on Amazon: Apr. 9, 2010, URL visited Oct. 11, 2012: http://www.amazon.com/OrigAudio-Portable-Vibration-Standard-ROCK-IT-WH/dp/B003BIFLN4/ref=pd_sim_sbs_e_2.

Author: Rico Mossesgeld, Title: These Torch Speakers Encase Your MP3 Player, Source: Tom's Guide US, Product Title: Music Torch, Date Published: Jun. 16, 2010, URL visited Jun. 27, 2010: http://www.tomsguide.com/us/Music-torch-mintpass-conceptnews-7093.html.

* cited by examiner

PORTABLE AUDIO AMPLIFIER WITH INTERCHANGEABLE HOUSING AND STORAGE COMPARTMENT

BACKGROUND

This application relates to portable audio amplifiers for portable audio players and musical instruments having an electrical output.

With the growing popularity of portable audio players and musical instruments has come a need for well-designed audio accessories. To amplify music to fill a room, or to share with friends, users must purchase an amplifier/speaker product. Consumers prefer products that combine functionality with customizability.

Many common devices have customizable aspects. Consumer products such as cell phones and GPS units may have interchangeable faceplates so the user can change the color or theme of their device's appearance. Audio amplifiers currently on the market offer no opportunity for users to express themselves and to be creative via customization of their product after purchase.

Portable amplifiers require a portable audio device which produces a signal for amplification. Audio signals are transmitted from the audio device to the amplifier via a cord, or wirelessly via an antenna. Amplifiers require the use of accessories, such as a cord, to make external amplification possible. Many portable amplifiers offer a retractable cord which stores inside of the amplifier housing, thus eliminating the need to carry a separate cord. Other portable amplifier products on the market offer an internal storage compartment, reducing the number of items the user must carry individually.

Consumers often wish to minimize the negative environmental impacts that products have on the world, which is reflected in the trend known as "going green." Consumers care about the planet and reflect this concern in the products they purchase. Many companies have moved into this market, creating products which utilize repurposed or recycled materials. Many portable amplifiers inside of repurposed materials can be found for sale online. By reusing old materials rather than throwing them away, new product manufacturing waste and environmental impact can both be minimized.

Products currently on the market include four primary types of devices:

a. Portable devices that include interchangeable faceplates, b. Portable speakers with amplification that can be used next to repurposed materials, c. Portable speakers with amplification inside of repurposed material, and d. Portable speakers with amplification containing an internal storage compartment.

FIG. 1 depicts an example of the first type of device: a computer mouse. This computer mouse can be customized after purchase using interchangeable faceplates. These faceplates may come in a variety of colors, textures, and materials that fit universally over or around the core product. Other devices, such as cell phones, GPS units, and computers, offer similar opportunities for customization.

An example of the second type of device is illustrated in FIG. 2: portable speakers with amplification that can be used next to repurposed materials. The product resembles a coffee cup lid and sits on top of a disposable coffee cup that is sold with the product. The product does not protrude into the cup itself—it simply operates on top of the cup. Inside of the amplifier enclosure resides a speaker, amplifier and battery. An audio cord, which connects the audio source to the amplifier, couples the audio signal from the audio device to the product. This device offers no storage compartment inside of the product to store the audio device, cord, nor other accessories such as batteries, adapters, and personal items. The product cannot be customized after purchase.

FIG. 3 is a generic drawing which represents the third type of device. Products of this variety include audio amplifiers such as a Dean Brown Can and a Cactus Tube Amp. These devices are portable amplifiers inside of repurposed materials that include a speaker, amplifier, and battery. A switch on the outside of the product turns the device on and off. An audio jack accepts a cable which couples the amplifier to an audio source, such as a guitar or portable music player. These amplifiers are housed in "repurposed materials"—a material whose intended purpose was other than audio amplification, such as a food or beverage can. Use of these amplifiers requires a cord to couple the amplifier and speaker to the audio source. However, no portable amplifier product which utilizes repurposed materials offers a storage compartment in which the user can store audio accessories such as cords, guitar picks, adapters, batteries, or even the portable audio device itself. Currently, users of the second type of device must transport individual accessories (listed previously) separately, making transportation more complicated and increasing the chances of lost or misplaced accessories. In addition, such devices cannot be customized after purchase.

An example of the fourth type of device is shown in FIG. 4. FIG. 4 illustrates the commercially available Kensington "Speakers To Go" portable speaker system. This product has a speaker which is visible from the outside when closed (not shown in FIG. 4). The unit opens like a book by unzipping around the perimeter to reveal an inner compartment which houses the battery, amplifier and cord. This inner compartment can also accommodate certain audio devices, accessories, and personal items such as keys or credit cards. Therefore, this amplifier provides a storage compartment for additional accessories such as batteries, guitar picks, and the player itself. It should be noted that the intended purpose of the device and all of its components is the amplification of music. Therefore, this product does not utilize "repurposed materials." Furthermore, the amplifier cannot be customized after purchase.

SUMMARY OF THE INVENTION

A portable music amplifier having an internal housing with a storage compartment and exchangeable elements, such as an external housing and cover. The exchangeable external housing may be made from repurposed materials, such as beverage or food containers. The storage compartment may contain audio accessories such as cords, adapters, batteries, and personal items, or even the audio source itself. The exchangeable external housing and cover of the storage compartment may also be exchanged after customer purchase.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as series forth hereinafter.

DETAILED DESCRIPTION

Figure 1:
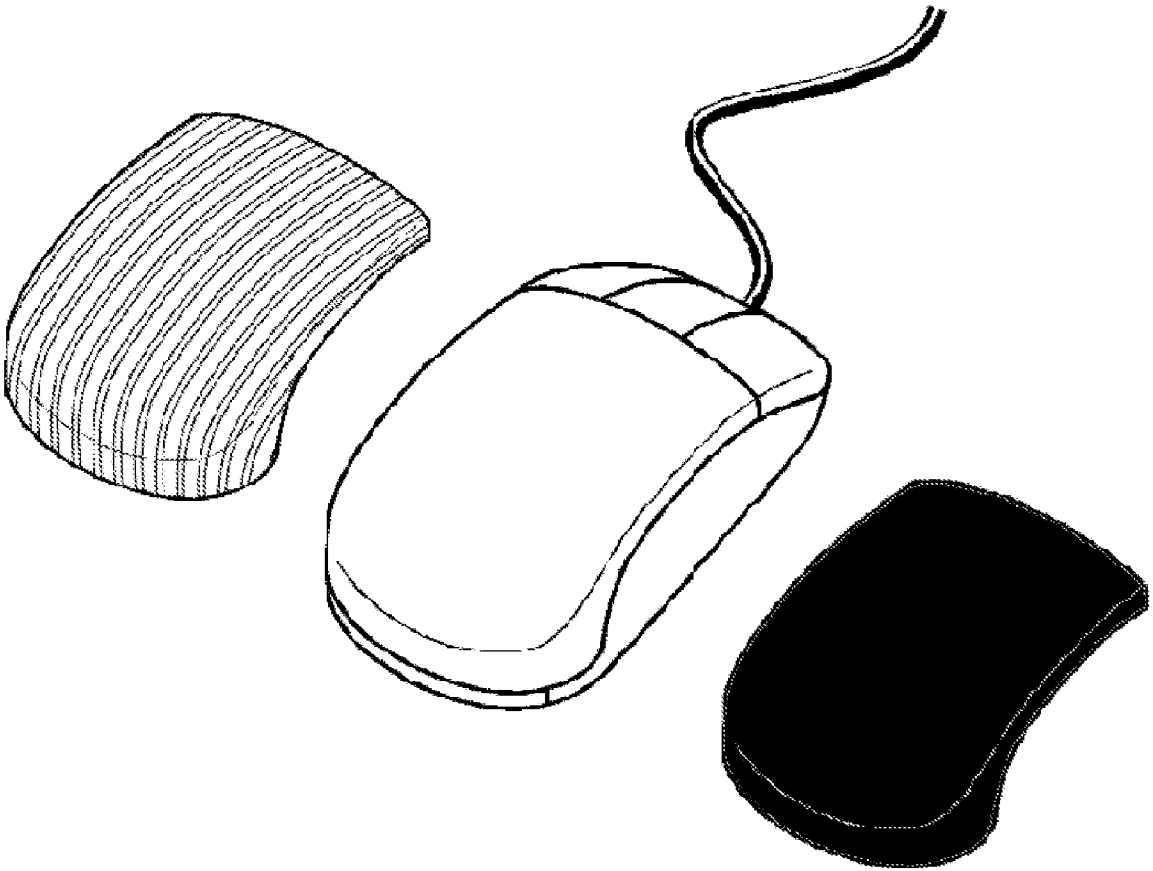
Figure 1 (prior art)
FIG. 1 shows a computer mouse with interchangeable faceplates.
Figure 2:
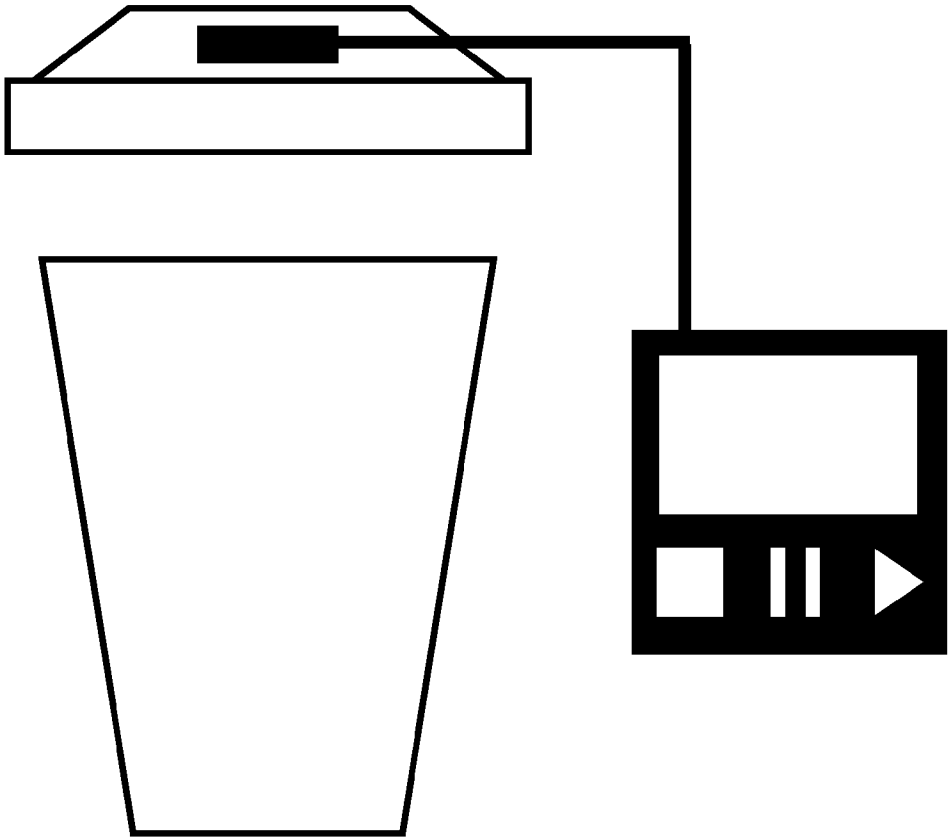
Figure 2 (prior art)
FIG. 2 shows portable speakers with amplification that can be used in conjunction with repurposed materials.
Figure 3:
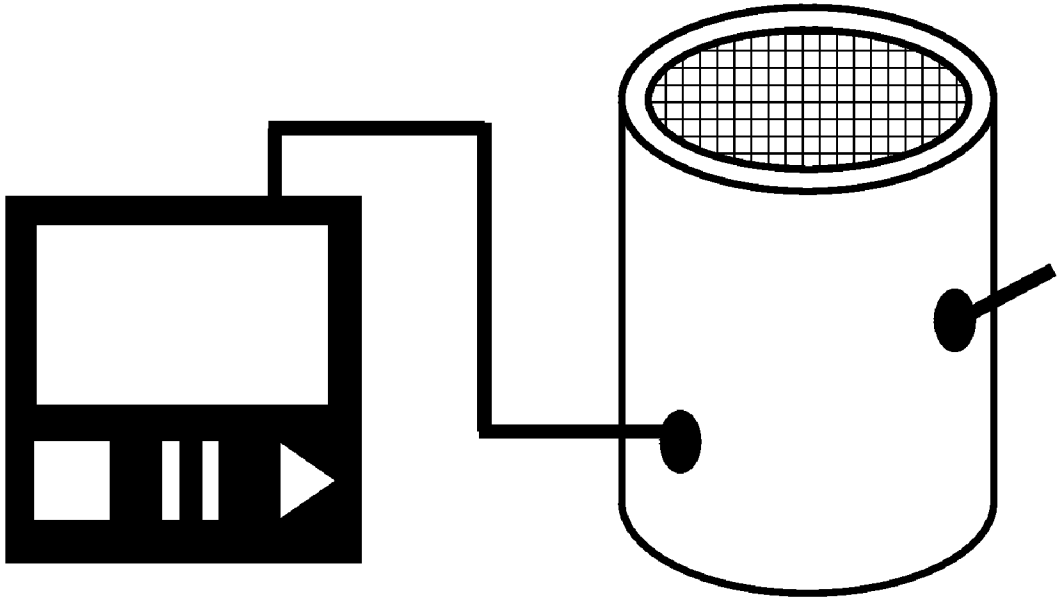
Figure 3 (prior art)
FIG. 3 shows a portable speaker system with amplification inside of repurposed materials.

For the purposes of promoting an understanding of the principles of the invention, reference will now be made to the exemplary embodiments illustrated in the drawing(s), and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to an "embodiment," an "example" or similar language means that a particular feature, structure, characteristic, or combinations thereof described in connection with the embodiment is included in at least one embodiment of the present invention. Thus, appearances of the phrases an "embodiment," an "example," and similar language throughout this specification may, but do not necessarily, all refer to the same embodiment, to different embodiments, or to one or more of the figures. Additionally, reference to the wording "embodiment," "example" or the like, for two or more features, elements, etc. does not mean that the features are necessarily related, dissimilar, the same, etc.

Each statement of an embodiment, or example, is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The features, functions, and the like described herein are considered to be able to be combined in whole or in part one with another as the claims and/or art may direct, either directly or indirectly, implicitly or explicitly.

As used herein, "comprising," "including," "containing," "is," "are," "characterized by," and grammatical equivalents thereof are inclusive or open-ended terms that do not exclude additional unrecited elements or method steps. "Comprising" is to be interpreted as including the more restrictive terms "consisting of" and "consisting essentially of."

Figure 5:
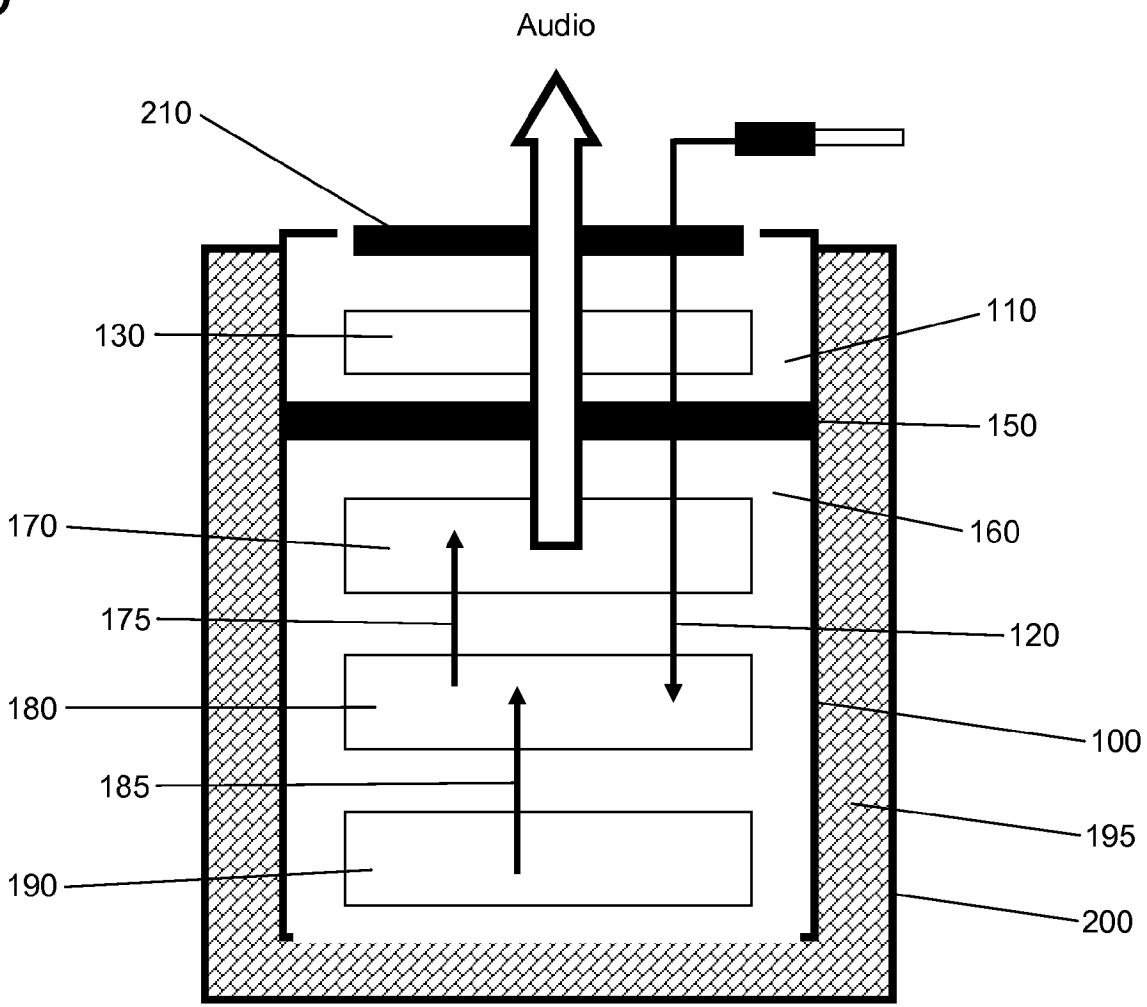
FIG. 5 shows a block diagram of the first embodiment of the present invention.

FIG. 5 shows a block diagram according to one embodiment of the present invention. An internal housing 100 contains all of the portable audio amplifier components. Internal housing 100 acts as the mechanical amplifier housing that contains the components required for amplification and also channels sound waves out of internal housing 100. Internal housing 100 is a hollow form made of plastic or metal in a preferred embodiment, but any material that provides the requisite mechanical stability may be used. Internal housing 100 may be inserted into external housing 200 for customization. The exchangeable external housing may be made from repurposed materials, such as beverage or food containers. In the case that internal housing 100 does not fit securely into external housing 200, internal housing 100 may be inserted into an adaptive structure 195 to provide mechanical stability between the internal housing 100 and external housing 200. Internal housing 100 contains two compartments: storage compartment 110 and electronics compartment 160. These two compartments are separated by guard 150.

The goal of an audio amplifier is to amplify an electrical, optical, wireless, or other audio signal source and to convert the audio signal source into human-audible sounds. Most audio amplifiers include a power source, electronics that amplify the audio signal source, and a speaker. In FIG. 5, electronics compartment 160 contains these components. These components are represented by power source 190 (typically but not exclusively a non-rechargeable battery, rechargeable battery, or "wall wart" transformer that converts common electrical power, such as 120 V and 60 Hz electricity into power that is suitable in voltage and current as input to amplifier electronics 180), amplifier electronics 180, and speaker 170. Power source 190 provides power to amplifier electronics 180 via power cable 185. Power cable 185 could also represent printed circuit board traces that couple power source 190 to amplifier electronics 180. Amplifier electronics 180 sends the amplified audio signal across speaker cable 175 to speaker 170. Amplifier electronics 180 can optionally include volume control, equalization, or other audio effects (not shown in FIG. 5). Guard 150, speaker 170, and amplifier electronics 180 may be fixed inside of storage compartment 160 via glue, fasteners, notches or other means of attachment within the internal housing 100.

Inside of internal housing 100, storage compartment 110 may contain a cord with connector 120 and accessories 130. Such accessories may include, but are not limited to, portable audio devices, batteries, guitar picks, adapters, or personal items. The user may optionally store their personal audio device (included with accessories 130) in storage compartment 110 during transport, use, or non-use (i.e. when the amplifier is turned off or is simply not connected to an external audio source). In FIG. 5, acoustically transparent grill 210 serves as a cover for storage compartment 110, keeping cord with connector 120 and accessories 130 contained and hidden from view while still allowing music to pass through. Also, grill 210 keeps unwanted objects from entering the amplifier.

In FIG. 5, cord with connector 120 extends from amplifier electronics 180 in electronics compartment 160, through or beside guard 150, then through storage compartment 110, and then through or beside grill 210, reaching outside of the amplifier to connect to a personal audio device such as an MP3 audio player, electric guitar, electronic keyboard, or similar audio source. Alternatively, to conceal the portable audio device, the user may keep the device attached to cord with connector 120 inside of storage compartment 110 during use and non-use, as long as the size of storage compartment 110 can accommodate the audio device.

Figure 4:
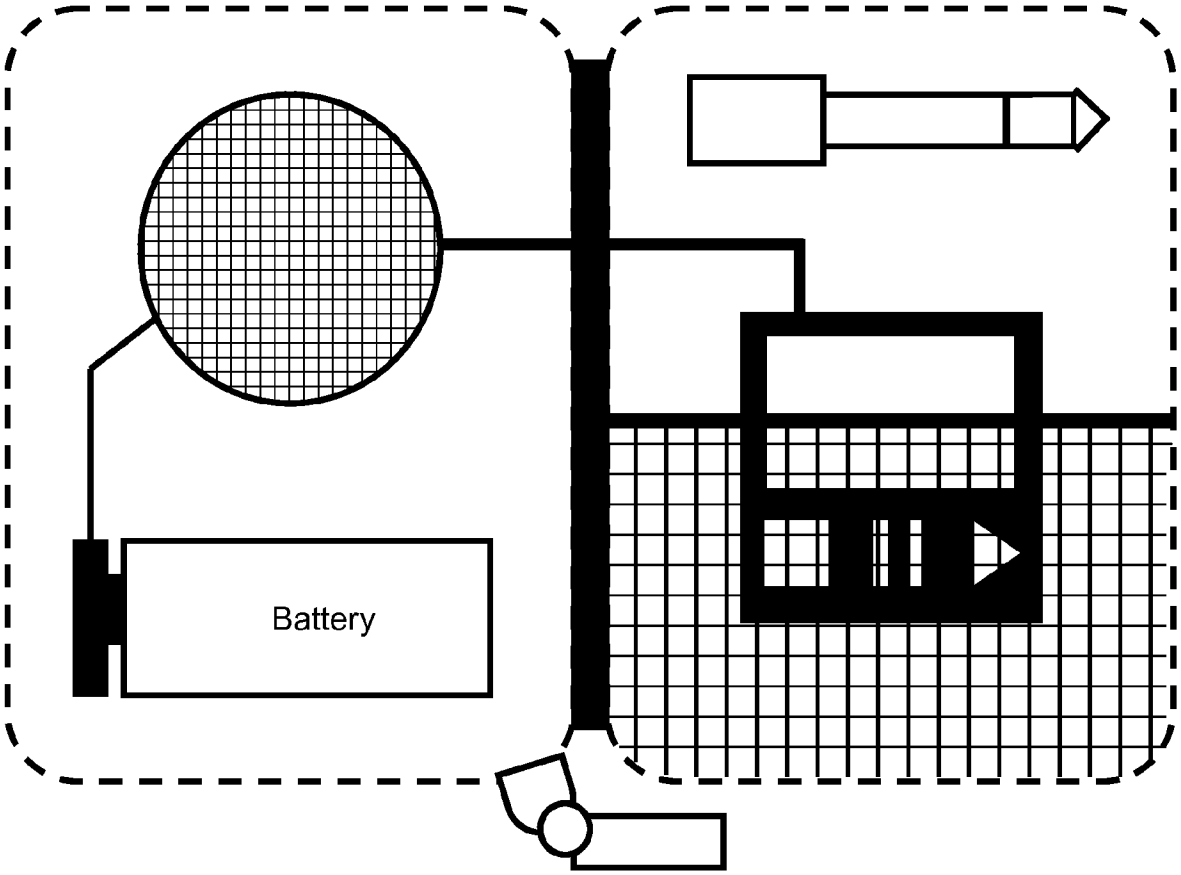
Figure 4 (prior art)
FIG. 4 shows a portable speaker system with amplification containing an internal storage compartment.

Cord with connector 120 includes a connector which is formed to attach to common external audio input sources (not shown in FIG. 4), such as a 3.5 mm audio socket in a portable audio player, a ¼ inch electric guitar jack, or other audio socket or coupling. The type of connector or connection (wireless or wired) that connects the external audio source to amplifier electronics 180 via cord with connector 120 does not limit the scope of the present invention. Embodiments of the present invention may use any connector or antenna that couples an external audio source to amplifier electronics 180. The opposing end of cord with connector 120 is provided as an input to amplifier electronics 180.

As previously stated, guard 150 separates storage compartment 110 from electronics compartment 160. Guard 150 keeps cord with connector 120 and accessories 130 from entering electronics compartment 160. Both grill 210 and guard 150 may be comprised of any material or combination of materials that allow for acoustic transparency, as music from speaker 170 passes through guard 150 and grill 210 to reach the listener(s). Guard 150 and grill 210 may be constructed of materials such as wood, plastic, metal, fiber or other material that can be perforated to achieve acoustic transparency. Alternatively, cloth or mesh material may be used independently, or in conjunction with the previous materials, to achieve acoustic transparency. In a preferred embodiment, grill 210 and guard 150 are circular pieces cut from sheets of selected material having the appropriate size, shape, and thickness which is compatible with internal housing 100. A variety of combinations for size, shape, color, material, etc. of grill 210 and guard 150 are possible. Embodiments of the present invention allow for different variations of grill 210 and external housing 200 to be easily removed and interchanged for customizability after purchase by a customer.

Figure 6:
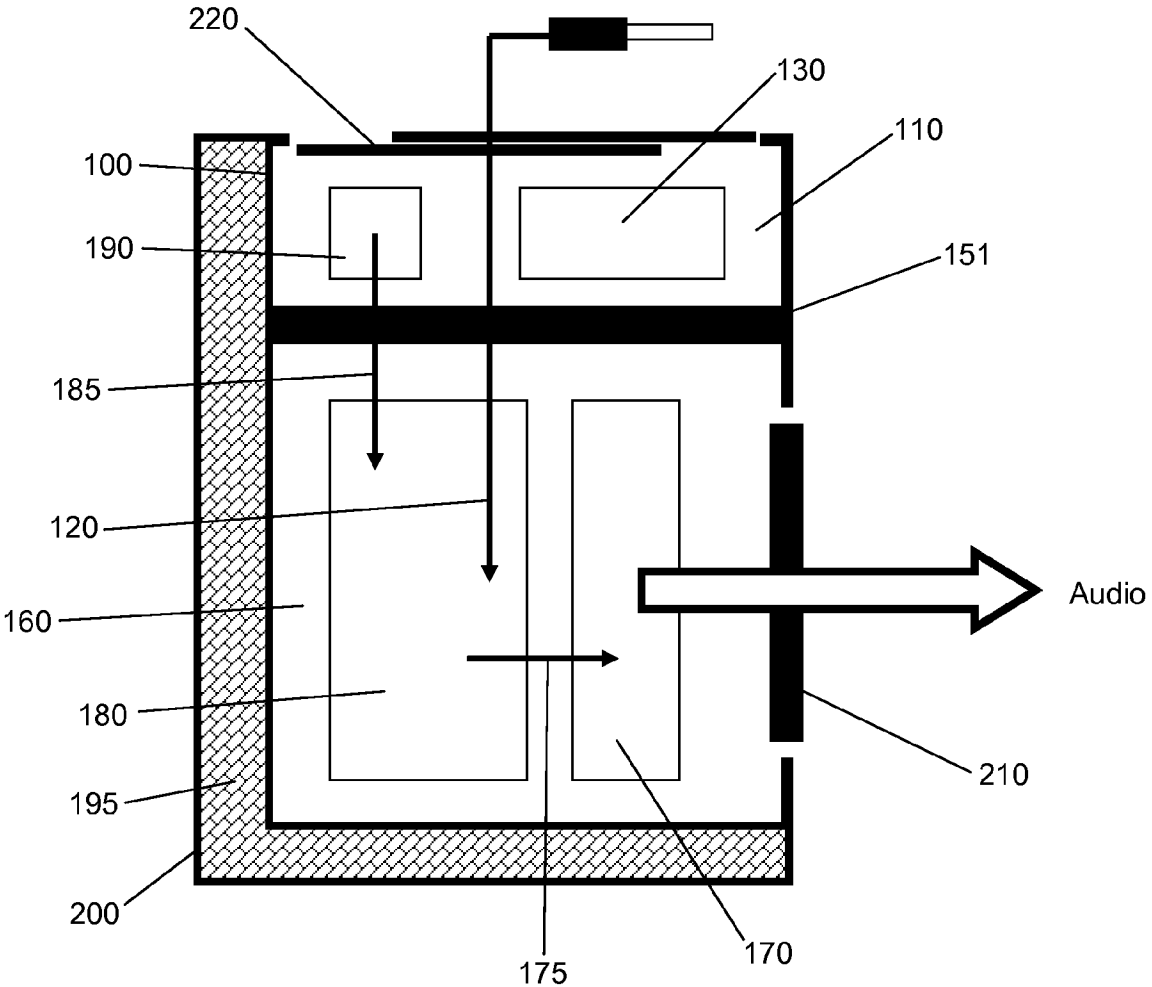
FIG. 6 shows a block diagram of the second embodiment of the present invention.

FIG. 6 shows a block diagram according to an alternative embodiment of the present invention. Many elements included in FIG. 6 are identical to those shown in FIG. 5. Therefore, elements not discussed in detail below have the same function and purpose as previously discussed in the specification with FIG. 5.

Internal housing 100 contains storage compartment 110 and electronics compartment 160. Internal housing 100 may be inserted into external housing 200 for customizability, and adaptive structure 195 may adapt the shape of internal housing 100 to fit properly inside of external housing 200. The exchangeable external housing may be made from repurposed materials, such as beverage or food containers. In FIG. 6, storage compartment 110 and electronics compartment 160 are separated by barrier 151. Barrier 151 is similar to guard 150 in FIG. 5, however barrier 151 is usually not acoustically transparent because music is not intended to travel through barrier 151. Barrier 151 may be comprised of any of the materials listed previously as appropriate for guard 150. However, audio traveling through barrier 151 should be minimized by choice of material type, shape and design.

In FIG. 6, power source 190 resides in storage compartment 110 to allow for easy user access. In an alternative embodiment, power source 190 may reside inside electronics compartment 160 without affecting the scope of the present invention. Power source 190 is coupled to amplifier electronics 180 via power cable 185, which travels through or beside barrier 151. Also inside of storage compartment 110 is cord with connector 120 and accessories 130. Cord with connector 120 extends through or beside barrier 151 to connect a portable audio device to amplifier electronics 180 in electronics compartment 160. In the embodiment of FIG. 6, the personal audio device may be kept outside the amplifier for easy access to device controls, such as volume adjustment or song selection. The personal audio device is coupled to amplifier electronics 180 via cord with connector 120. Alternatively, the personal audio device (included in accessories 130) and cord with connector 120 may be hidden inside of storage compartment 110 during use or non-use.

Storage compartment 110 may have a cover, represented in FIG. 6 by door 220. Door 220 is functionally similar to grill 210 in FIG. 5, but door 220 does not require acoustic transparency. The materials appropriate for door 220 are identical to the materials listed above as appropriate for guard 150. Door 220 keeps cord with connector 120 and accessories 130 inside of storage compartment 110. Door 220 may be removed to access cord with connector 120 or accessories 130, and will otherwise cover storage compartment 110.

Electronics compartment 160 contains amplifier electronics 180, which sends an amplified audio signal to speaker 170 via speaker cable 175. Barrier 151, speaker 170, and amplifier electronics 180 may be fixed inside of storage compartment 160 via glue, fasteners, or notches or other appropriate mechanism within the internal housing 100. As in FIG. 5, grill 210 must be acoustically transparent to allow audio to pass out of the amplifier. In this embodiment, grill 210 no longer serves as a cover for storage compartment 160, but instead serves as a cover for speaker 170. A variety of combinations of size, shape, color, material, etc. of grill 210 and door 220 may be used. Different variations of grill 210, door 220, and external housing 200 may be interchanged for customizability after purchase.

Figure 7:
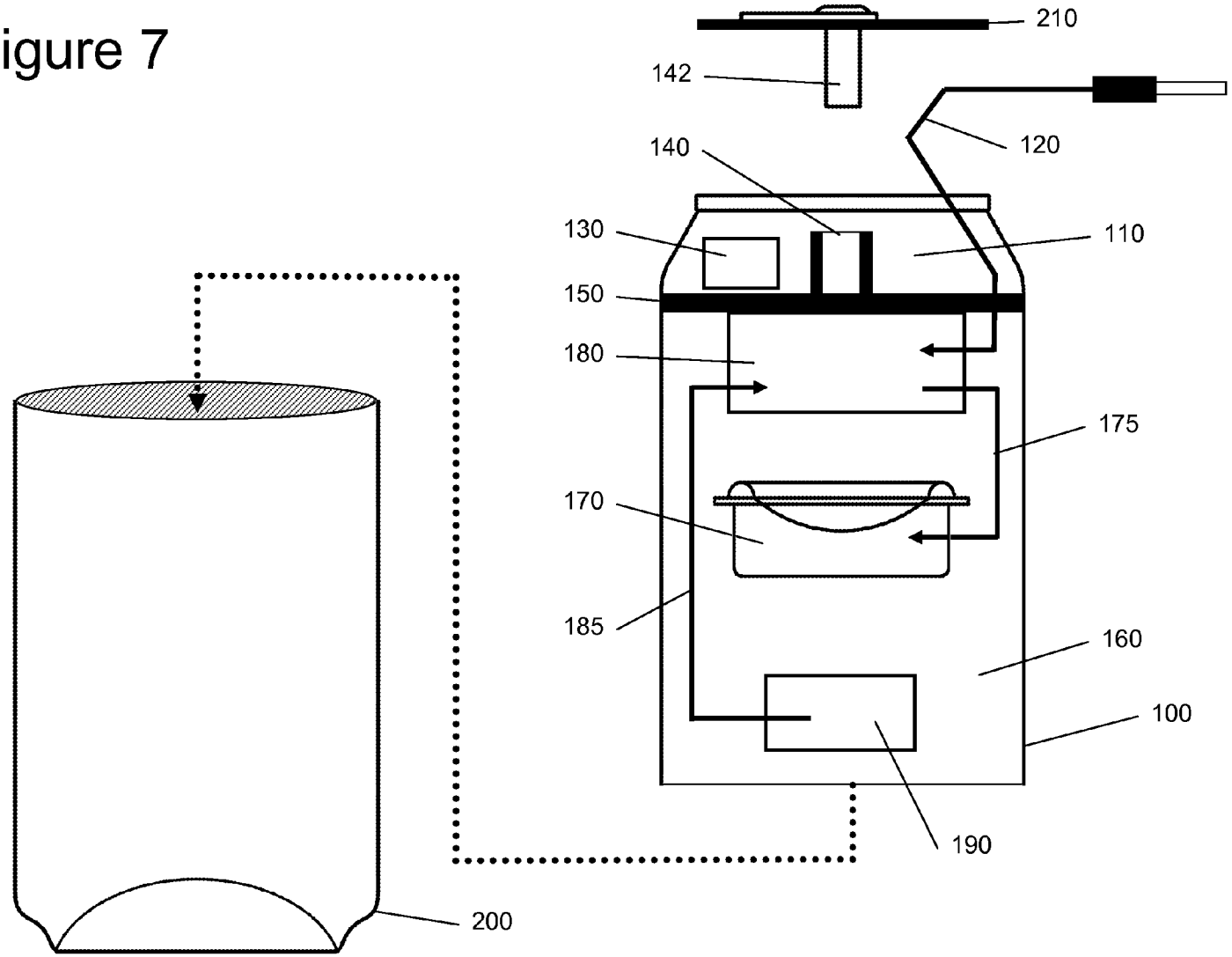
FIG. 7 shows an embodiment of the invention with a removable grill.

FIG. 7 illustrates an example of the embodiment explained in FIG. 5, with a focus on how storage compartment 110 may be formed. Many aspects described in FIG. 7 are identical to those shown in FIG. 5. Thus elements not discussed in detail below have the same function and purpose as previously explained in the specification with FIG. 5.

Internal housing 100 may reside in, or be inserted into, external housing 200. In FIG. 7, external housing 200 is shown in the shape of a metal beverage can, but the present invention envisions a variety of possibilities for external housing 200. Materials for the external housing 200 include: manufactured and repurposed materials. An embodiment of the present invention may utilize a manufactured external housing 200 that was designed and manufactured specifically to contain internal housing 100. Alternative embodiments may use a repurposed external housing 200—a housing whose primary purpose was other than audio amplification. Such a repurposed external housing 200 is pictured in FIG. 7. Other repurposed external housing alternatives include metal or plastic lunch boxes, paper or plastic beverage cups, glass Mason jars, Chinese take-out cardboard or plastic food boxes, Tupperware™, plastic storage containers, or other hollow objects etc. The scope and embodiments of external housing 200 are not limited by these examples, but are only limited by the present invention's claims.

The user may select a repurposed external housing that is modifiable. A repurposed external housing may be modified using scissors, a knife, or other cutting tool to accommodate internal housing 100. Modifications may include removing a portion of the repurposed external housing, such as cutting off the top or bottom portion of a soda or beer can, to allow external housing 200 to surround internal housing 110 to a user-selected depth. Additional modifications to the repurposed item may include hole-making via cutting, punching, or drilling. The user may modify or exchange external housing 200 themselves after purchase with an alternate external housing 200 having a different design, pattern, or brand (such as using a can from a different brand of soda or beer).

The upper portion of internal housing 100 (above guard 150) comprises storage compartment 110, and the lower portion of internal housing 100 (below guard 150) comprises electronics compartment 160. Guard 150 keeps cord with connector 120 and accessories 130 from falling down into electronics compartment 160 because guard 150 may be fixed inside of internal housing 100. Socket 140 is attached to guard 150, which interfaces with connection post 142 on grill 210. Socket 140 and connection post 142 are most commonly cylindrical members, but may be other shapes, made of plastic or metal. Any form or material providing the requisite mechanical stability and functionality is acceptable. Connection post 142 may connect grill 210 to guard 150 via friction (press fit), magnets (i.e. one magnet polarity inside of socket 140 and the other magnet polarity attached to connection post 142), or threads matched with socket 140. Because connection post 142 is held inside of socket 140 while grill 210 is attached, grill 210 is unable to pivot, nor may it to translate in any direction except up and down along the central axis extending out of the top of internal housing 100. A variety of combinations of size, shape, color, material, etc. for grill 210 exist. Therefore, different variations of grill 210 may be removed and interchanged for customizability.

In an alternative embodiment, grill 210 may include a tether or tab on the upper surface that the user can grasp to pull grill 210 upward for removal and access to storage compartment 110. The tab on grill 210 may take several forms, including a metal tab (such as is present on most metal soda or beer cans), a string, a leather tab, or other similar grip.

When cord with connector 120 is not in use, it can be stored in storage compartment 110 and is hidden from view by removable grill 210. When the user wishes to operate the device, grill 210 is removed, cord with connector 120 is extended and connected to a personal audio device, and then grill 210 is placed back over storage compartment 110. When cord with connector 120 is extended for use, as shown in FIG. 7, it travels through or beside guard 150, through storage compartment 110, and then through or beside grill 210 out of the amplifier.

Within electronics compartment 160 resides amplifier electronics 180. Amplifier electronics 180 may include switches, volume knobs, inputs and LED indicators. These components may protrude through guard 150, allowing the user to access the controls via storage compartment 110. When amplifier electronics 180 are located just below guard 150, the thickness of guard 150 allows the controls on amplifier electronics 180 to protrude through for user access. Amplifier electronics 180 are coupled to speaker 170, which plays music that travels past amplifier electronics 180, through acoustically transparent guard 150, through storage compartment and through grill 210. Speaker 170 and amplifier electronics 180 may be fixed inside of storage compartment 160 via glue, fasteners, or notches on the inside of internal housing 100. Power source 190 is normally fixed inside of storage compartment 160 via magnets, friction or mechanical restraint, but power source 190 may be removed by the user for replacement when power source 190 is (for example) a non-rechargeable or rechargeable battery.

When the user wishes to access power source 190, one may remove internal housing 100 from external housing 200 to reveal an open bottom of internal housing 100. The user may only require access to power source 190 occasionally and therefore will rarely remove internal housing 100 from external housing 200 for replacement or recharging of power source 190. More commonly, the user will remove internal housing 100 from external housing 200 to switch to an alternate external housing 200 having a different color, material, or shape, thus providing customizability.

Figure 8:
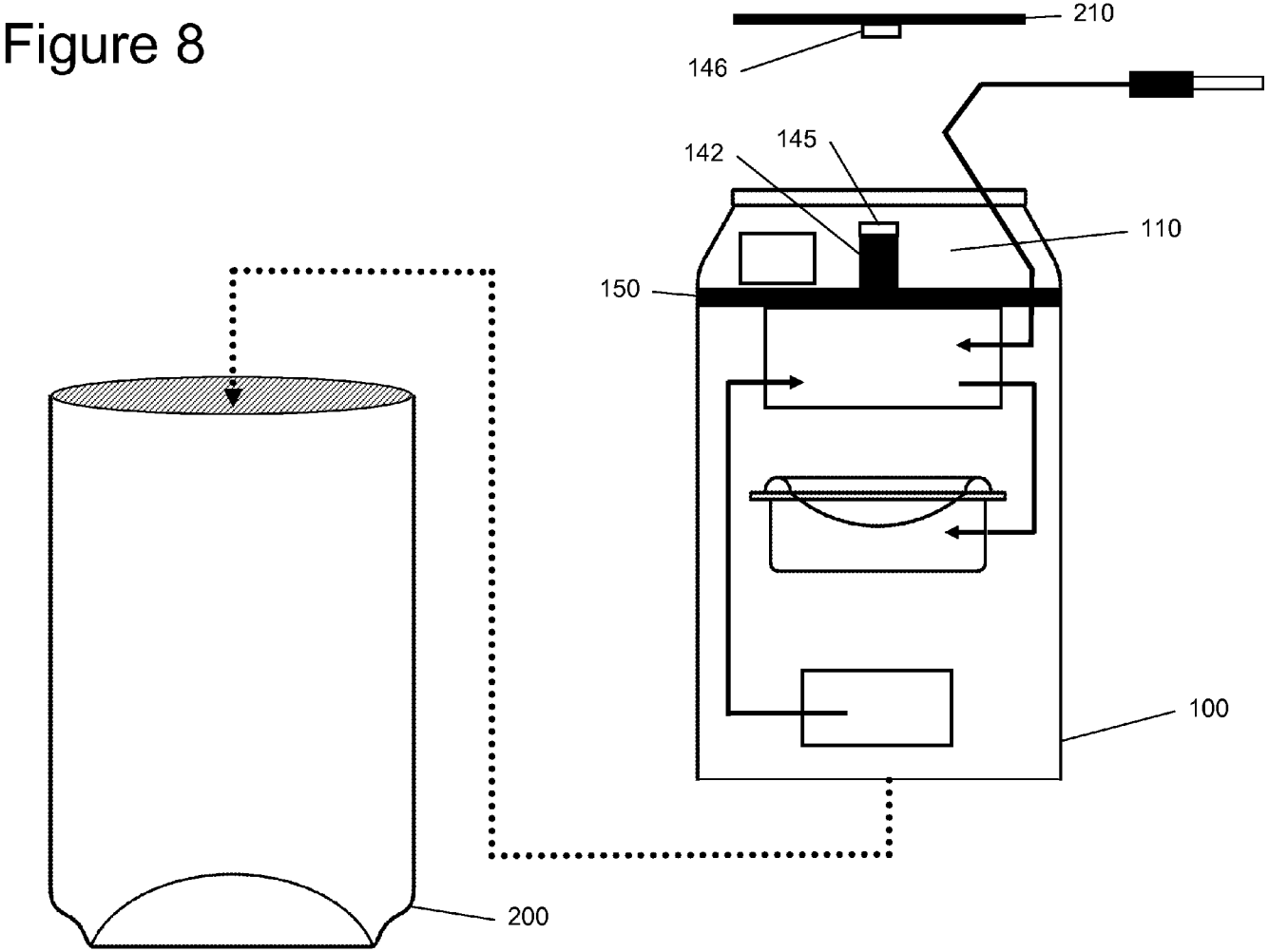
FIG. 8 shows a preferred embodiment of the invention with magnetic grill.

FIG. 8 shows an embodiment wherein magnetic elements attached the grill 210 to a connection post 142 and is described with respect to FIG. 7. FIG. 8 differs from FIG. 7 by the means of attaching grill 210 to internal housing 100. Internal housing 100 may reside in external housing 200. The exchangeable external housing may be made from repurposed materials, such as beverage or food containers. In FIG. 8, external housing 200 is shown in the shape of a metal beverage can, but a variety of possibilities for external housing 200 exist, as discussed previously.

In FIG. 8, connection post 142, which is attached via mechanical fastener to guard 150, is fixed inside of internal housing 100. Connection post 142 may be attached to guard 150 by mechanical fasteners, glue, tape, friction, or any other method providing the requisite mechanical stability. Magnetic elements may be used to couple the grill 210 to the connection post 142. These magnetic elements may include discrete magnets that attach to each other or consist of a magnet that attaches to a ferromagnetic material such as iron, nickel, or steel. In one embodiment connection post magnet 145 sits on top of connection post 142 and may be held in place by mechanical fasteners, glue, tape, friction, or any other method providing the requisite mechanical stability.

Grill magnet 146 is attached to grill 210, which serves as a cover for storage compartment 110. Grill magnet 146 may be attached to grill 210 by mechanical fasteners, glue, tape, friction, or any other method providing the requisite mechanical stability. During transport or use, grill 210 is held over storage compartment 110 via magnetism between grill magnet 146 and connection post magnet 145. When access to storage compartment 110 is desired, the user applies a force near the perimeter of grill 210 toward guard 150 (downward), causing grill 210 to pivot, allowing the user to grip along the perimeter and remove grill 210. When access to storage compartment 110 is finished, grill 210 will snap back over storage compartment 110 via magnetism when put in close proximity to connection post magnet 146. By using magnets, which mate face to face but do not interlock or protrude inside one another, grill 210 doesn't require a tether for removal up and down along the central axis extending from the top of internal housing 100, as in FIG. 7, but rather pivots for removal when the user applies a force along the perimeter.

Figure 9:
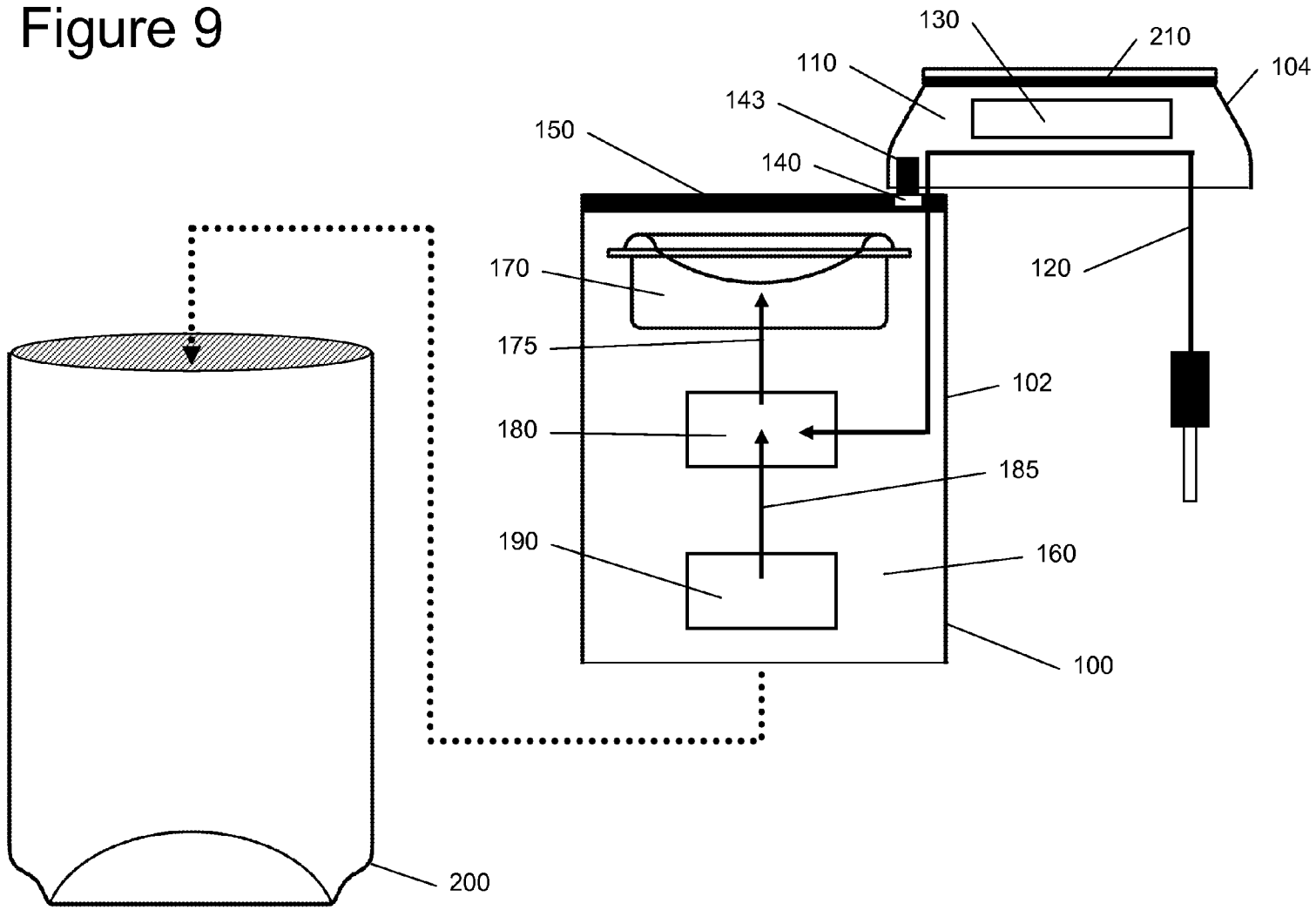
FIG. 9 shows an embodiment of the invention with a swivel.

FIG. 9 illustrates an example of the embodiment described with respect to FIG. 5. FIG. 9 illustrates an alternate form of storage compartment 110. Internal housing 100 may reside in external housing 200. The exchangeable external housing may be made from repurposed materials, such as beverage or food containers. In FIG. 9, external housing 200 is shown in the shape of a metal beverage can, but a variety of possibilities for external housing 200 exist, as discussed previously.

Upper internal housing 104, the upper portion of internal housing 100, comprises the storage compartment 110, while lower internal housing 102, the lower portion of internal housing 100, makes up electronics compartment 160. Together upper internal housing 104 and lower internal housing 102 comprise internal housing 100. Electronics compartment 160 contains elements identical to those discussed with FIG. 7. Guard 150 keeps cord with connector 120 and accessories 130 from falling down into electronics compartment 160 because guard 150 is fixed to the top of lower internal housing 102. Grill 210 is fixed to the top of upper internal housing 104 to create storage compartment 110 and may be attached via glue, tape adhesive, friction, bending, or other appropriate fastening method.

Swivel pin 143 connects the upper internal housing 104 containing storage compartment 110 to the lower internal housing 102 containing electronics compartment 160 via socket 140. More specifically, upper internal housing 104 is attached to swivel pin 143, which may rotate in socket 140, which is attached to guard 150. Because guard 150 is attached to the top of lower internal housing 102, upper internal housing 104 is attached to lower internal housing 102 via the swivel pin 143 and socket 140 which holds the swivel pin 143. Swivel pin 143 in socket 140 prevents translation of the upper internal housing 104 and typically only allows rotation about one axis. Swivel pin 143 and socket 140 are most commonly cylindrical members made of metal or plastic, but any form or material providing the requisite mechanical stability and functionality is acceptable.

When the user wishes to access storage compartment 110, the user pivots upper internal housing 104 away from lower internal housing 102. During typical non-operating (non-amplifying) conditions, upper internal housing 104 is aligned directly above lower internal housing 102. When opening storage compartment 110, the user may flip the unit upside down, using gravity to keep cord with connector 120 and accessories 130 inside of storage compartment 110. After pivoting upper internal housing 104, the lower end of upper internal housing 104 is open. In this relative positioning, the user may then extend cord with connector 120 for amplifier operation, or the user may access accessories 130. When access is no longer required, the user pivots upper internal housing 104 back over lower internal housing 102 to close storage compartment 110 for transport or operation. Upper internal housing 104 may be prevented from unintentionally pivoting away from lower internal housing 102 via friction, ratchet mechanism, magnetic clasp, mechanical clasp, or similar mechanism.

Special cases may exist in which upper internal housing 104 simultaneously pivots about an axis and translates along the axis—such usage is also anticipated as a valid embodiment of the present invention. In FIG. 9, upper internal housing 104 rotates about a vertical axis (any axis parallel to the central axis of internal housing 100), but the present invention is not limited to a specific axis of rotation. A swivel pin 143 whose central axis intersects the upper surface of guard 150 may be positioned tangent to the perimeter of guard 150. This would create a hinge effect. Alternatively, upper internal housing 104 may translate up and down along the central axis extending from the center of internal housing 100 by similar means as grill 210 in FIG. 5 instead of swiveling or pivoting via hinge. In FIG. 5, grill 210 may also be combined with the functionality introduced with swivel pin 143 to allow for pivoting of grill 210 instead of or in addition to translation of grill 210 for access to storage compartment 110. For example, a swivel pin 143 which lies along the diameter of grill 210 would create a see-saw motion. This motion would be achieved via sockets in internal housing 100 that hold either end of swivel pin 143. The user would apply a force toward guard 150 (downward) to pivot the grill along for access to storage compartment 110.

Figure 10:
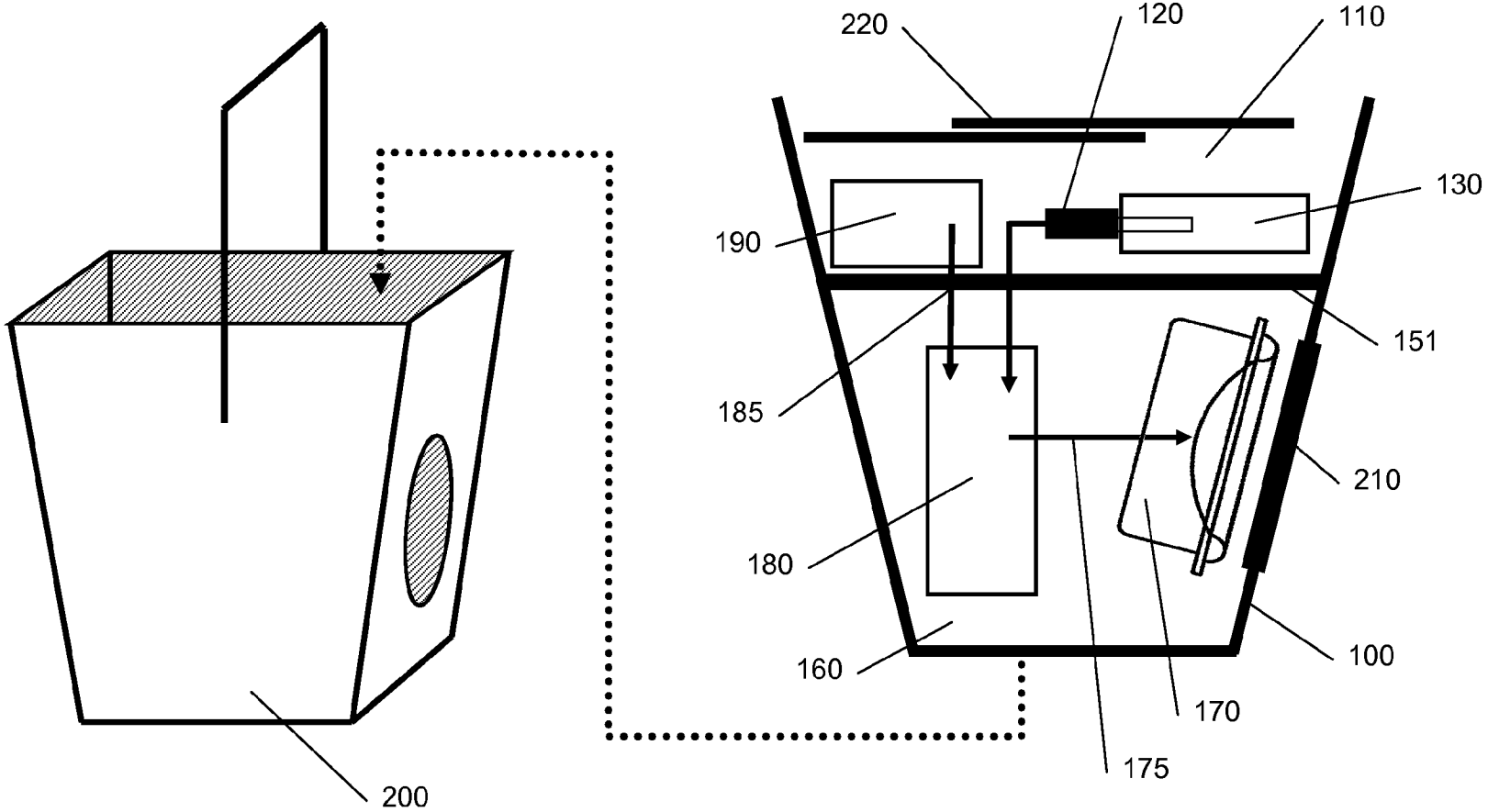
FIG. 10 shows an embodiment of the invention with a sliding door.

FIG. 10 illustrates another example of the embodiment described in FIG. 6, with a focus on how storage compartment 110 may be formed. Many aspects described in FIG. 10 are identical to those shown in FIG. 6. For this reason, elements not discussed below may be assumed to have the same function and purpose as previously explained in the specification with FIG. 6.

Internal housing 100 may reside in external housing 200. The exchangeable external housing may be made from repurposed materials, such as beverage or food containers. In FIG. 10, external housing 200 is shown in the shape of a Chinese take-out food box, but (as previously stated) the present invention envisions a variety of materials and shapes for external housing 200. The user may remove internal housing 100 from external housing 200 to switch to an alternate external housing 200 having different color, material, or shape properties for customizability.

The upper portion of internal housing 100 comprises storage compartment 110, and the lower portion of internal housing 100 comprises electronics compartment 160. Barrier 151 keeps cord with connector 120, accessories 130, and power source 190 from falling down into electronics compartment 160 because barrier 151 is typically fixed inside of internal housing 100. In FIG. 10, door 220 serves as a cover for storage compartment 110 and may slide parallel to barrier 151, to reveal or hide the storage compartment 110. Sliding is achieved via tabs on door 220 which fit inside slots in internal housing 100. The relative size of the tabs and slots define the range of motion possible for door 220. In another case, the interface between door 220 and internal housing 100 may have sliding elements comprised of wheels, bearings, or collars which slide on rails that are attached to the side of the internal housing.

In alternate embodiments, door 220 may translate in another direction, for instance, away from barrier 151 while remaining parallel to barrier 151 (vertically), which is functionally similar to the motion described in FIG. 7. Alternatively, door 220 may pivot as described in FIG. 9 to reveal storage compartment 110. In addition, the sliding motion presented here may also be applied to grill 210 in FIG. 7 instead of translation along the central axis of internal housing 100, and to upper internal housing 104 in FIG. 9, instead of a swivel or hinge function about the axis of a swivel pin.

Electronics compartment 160 contains speaker 170 and amplifier electronics 180. Grill 210 protects speaker 170 inside of electronics compartment 160, and may be removably attached to internal housing 100 via friction (press fit), magnets, or a threaded shaft matched with an appropriate socket. The user may remove grill 210 and replace with an alternate grill 210 of different size, design, color, or material for customizability.

When cord with connector 120 is not in use, it is stored in storage compartment 110 and is hidden from view via door 220 acting as a cover. Also, accessories 130, which may include the portable audio device, reside in storage compartment 110. To use the amplifier in FIG. 10, the user slides door 220 to reveal storage compartment 110. Then cord with connector 120 is extended and connected to a personal audio device or musical instrument with electrical output, and door 220 is slid back over storage compartment 110 to contain remaining contents. When cord with connector 120 is extended for use, it travels through or beside barrier 151, through storage compartment 110, and then through or beside door 220 out of the amplifier. If the user wishes to conceal the portable audio device, they may keep the device attached to cord with connector 120 inside of storage compartment 110 during use and non-use, as long as the size of storage compartment 110 can accommodate the device.

When the user wishes to access power source 190, the user simply slides door 220 to reveal storage compartment 110. Power source 190 is connected to amplifier electronics 180 via power cable 185 which runs through or beside barrier 151. Amplifier electronics 180 may include switches, volume knobs, inputs and LED indicators. These components may protrude through barrier 151 so the user can access the controls via storage compartment 110. Next to amplifier electronics 180 is speaker 170, which creates sound waves that travel through acoustically transparent grill 210. Speaker 170 and amplifier electronics 180 may be fixed inside of storage compartment 160 via glue, fasteners, or notches on the inside of internal housing 100.

Figure 11:
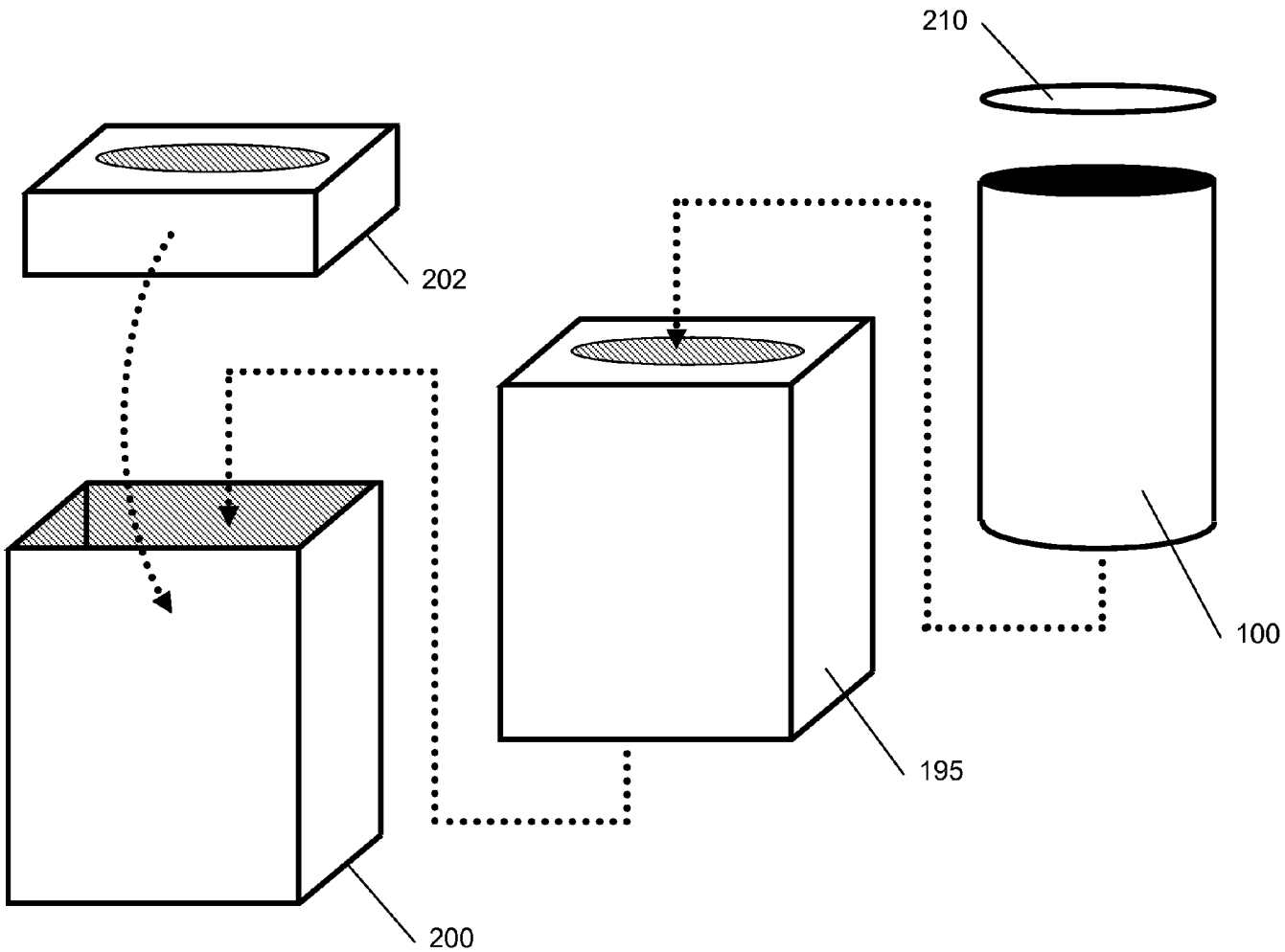
FIG. 11 shows an embodiment of the invention illustrating interchangeable housing and solid style adaptive structure.

FIG. 11 illustrates internal housing 100 prior to insertion into adaptive structure 195, which fits into external housing 200. In FIG. 11, external housing 200 resembles a tissue box, but it may embody any variety of options, manufactured or repurposed, that have been discussed previously. To enclose internal housing 100 inside a variety of larger sizes and shapes for external housing 200, the user may utilize an adaptive structure 195 to support and adapt internal housing 100 to fit with the desired mechanical stability into external housing 200. It should be noted that adaptive structure 195 may not be necessary when internal housing 100 already fits with the desired mechanical stability inside external housing 200.

Internal housing 100 contains all elements necessary for audio amplification. Grill 210 serves as a lid for inner housing 100. When external housing 200 is moderately or significantly larger than internal housing 100, or is of a different shape, the user may insert internal housing 100 into adaptive structure 195. Internal housing 100 may be held inside of adaptive structure 195 using glue, fasteners, friction, magnets, or a mechanical clasp. Adaptive structure 195, which contains internal housing 100, resides in (or is surrounded by) external housing 200. Adaptive structure 195 may be held inside external housing 200 using glue, fasteners, friction, magnets, or a mechanical clasp. The user may require access to power source 190 (not shown) for replacement or electronics compartment 160 (not shown) for maintenance. If internal housing 100 is attached to adaptive structure 195, then the user may remove both internal housing 100 and adaptive structure 195 simultaneously. Alternatively, if adaptive structure 195 is attached to external housing 200, then the user may simply remove internal housing 100 from adaptive structure 195. In FIG. 11, the three elements are preferably held together using only friction and may therefore be complete separated from each other if the user so desires.

The preferred material for adaptive structure 195 in the current embodiment is foam because it is light weight and provides the requisite mechanical stability. However, adaptive structure 195 may also be comprised of wood, metal, plastic, rubber, cardboard, or other appropriate material. Adaptive structure 195 may be a solid piece of material with a single cavity for internal housing 100 as shown in FIG. 11, a solid style adaptive structure, however alternatives exist and will be discussed in more detail in following figure specifications. The outer surface of adaptive structure 195 shall resemble all or some portion of the inner surface of external housing 200. Adaptive structure 195 is not required to fill all of the space between internal housing 100 and external housing 200. Any alternative of adaptive structure 195 that keeps internal housing 100 mechanically fixed inside of external housing 200 is acceptable.

External housing 200 may be comprised of multiple parts, one of which is represented by external housing addition 202. In FIG. 11, external housing addition 202 is a mating lid that keeps adaptive structure 195 and internal housing 110 from falling out, and also keeps them concealed. External housing addition 202 may be a portion of external housing 200 that has been separated. Alternatively, external housing addition 202 may be a piece formed separately, or a piece of another external housing 200.

Only grill 220 can be seen, removed, and interchanged while external housing addition 202 is attached to external housing 200. External housing addition 202 may be fixed to external housing 200 using glue, fasteners, friction, magnets, or a mechanical clasp to contain internal housing 100. Alternatively, external housing 200 and external housing addition 202 may both be attached to internal housing 110 using methods previously listed.

Figure 12:
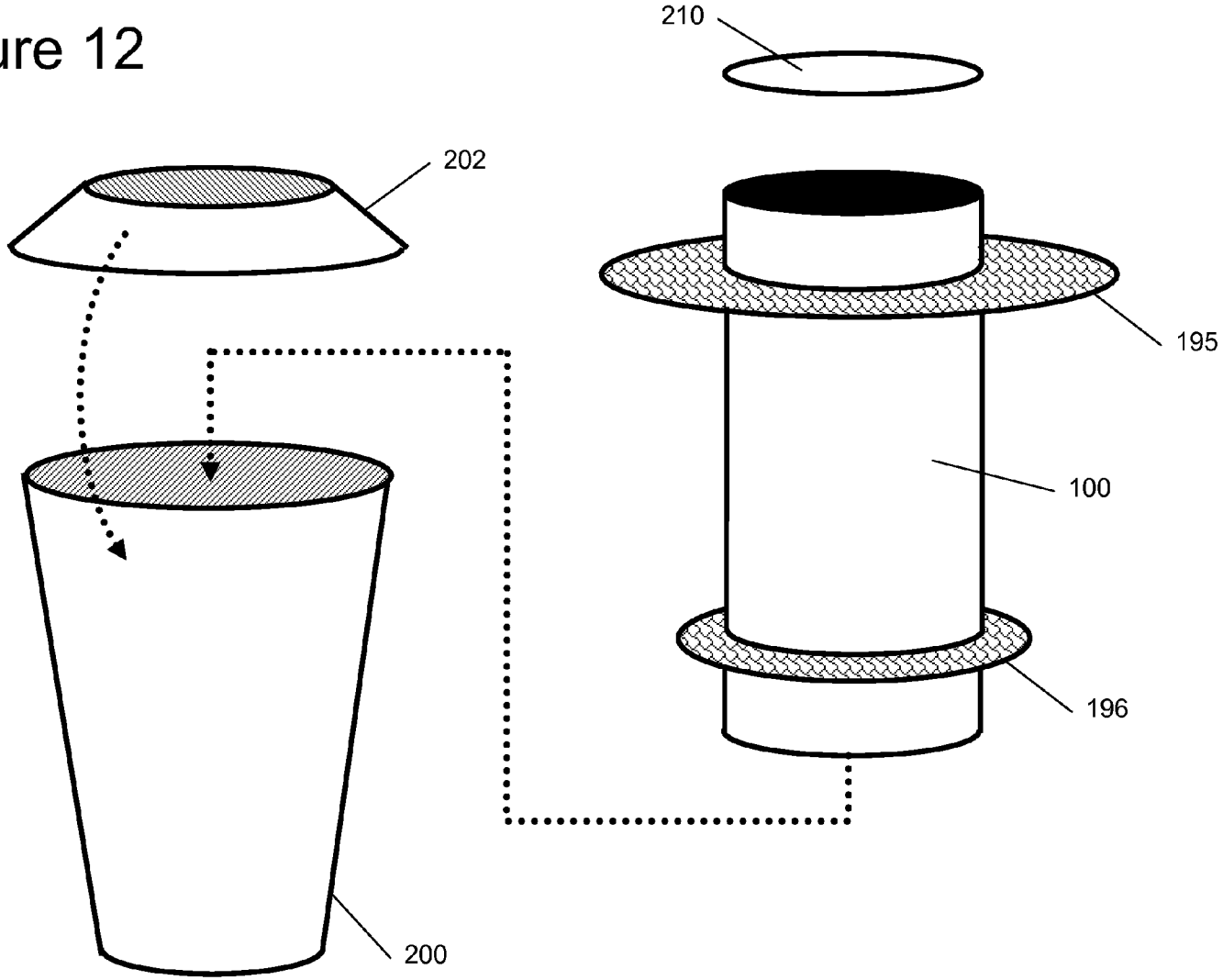
FIG. 12 shows a preferred embodiment of the invention with ring style adaptive structure.

FIG. 12 shows a preferred embodiment described with respect to FIG. 11. FIG. 12 utilizes a flat ring style adaptive structure 195, which differs from the solid style adaptive structure 195 shown in FIG. 11. Ring style adaptive structures have sufficient rigidity to prevent the internal housing 100 from moving in the axial direction.

Internal housing 100 may reside in external housing 200. The exchangeable external housing may be made from repurposed materials, such as beverage or food containers. In FIG. 12, external housing 200 is shown in the shape of a disposable coffee cup, but a variety of possibilities for external housing 200 exist, as discussed previously. Grill 210, a removable cover for storage compartment 110 (not shown), normally sits on top of internal housing 100.

Because external housing 200 is significantly larger than internal housing 100, adaptive structure 195 may be utilized to increase mechanical stability. In FIG. 12, adaptive structure 195 is a flat piece of material preferably made of cardboard, but the materials may be extended to a combination of foam, cardboard, wood, plastic and metal. Additional adaptive structure 196 may be added for increased mechanical stability and may be made of the same materials appropriate for adaptive structure 195.

The shape of adaptive structure 195 and additional adaptive structure 196 are defined by the external surface of internal housing 100 and the internal surface of external housing 200. In this case, adaptive structure 195 and additional adaptive structure 196 resemble rings, adapting the cylindrical surface of internal housing 100 to the larger conical surface of external housing 200.

Adaptive structure 195 and additional adaptive structure 196 are applied to internal housing 100 prior to insertion into external housing 200. Friction is the preferred means of attaching adaptive structure 195 and additional adaptive structure 196 to internal housing 100, however adhesives, tapes, fasteners, or magnets may also be used. After adaptive structure 195 and additional adaptive structure 196 have been secured to internal housing 100, the entire assembly can be inserted into external housing 200.

To contain and conceal the assembly inside of external housing 200, external housing addition 202 may be applied, which in FIG. 12 resembles a disposable coffee cup lid. In the present case, adaptive structure 195 and additional adaptive structure 196 do not keep internal housing 100 from falling out of external hosing 200 when turned upside down, therefore external housing addition 202 acts as a barrier providing mechanical stability. This mechanical stability comes from the lower rim of external housing addition 202 gripping the top rim of external housing 100, however other methods of attachment such as friction, magnets, Velcro, or fasteners are possibilities. Alternatively, adaptive structure 195 and additional adaptive structure 196 may provide the requisite mechanical stability and therefore external housing addition 202 may used for aesthetic reasons, or may not be used at all.

When compared to the solid style adaptive structure from FIG. 11, this variety of adaptive structure 195 and adaptive structure addition 196 minimize weight, cost, and manufacturing complexity while maintaining strength. Adaptive structure 195 and adaptive structure addition 196 may be painted or finished to increase aesthetics in designs in which they are exposed.

Figure 13:
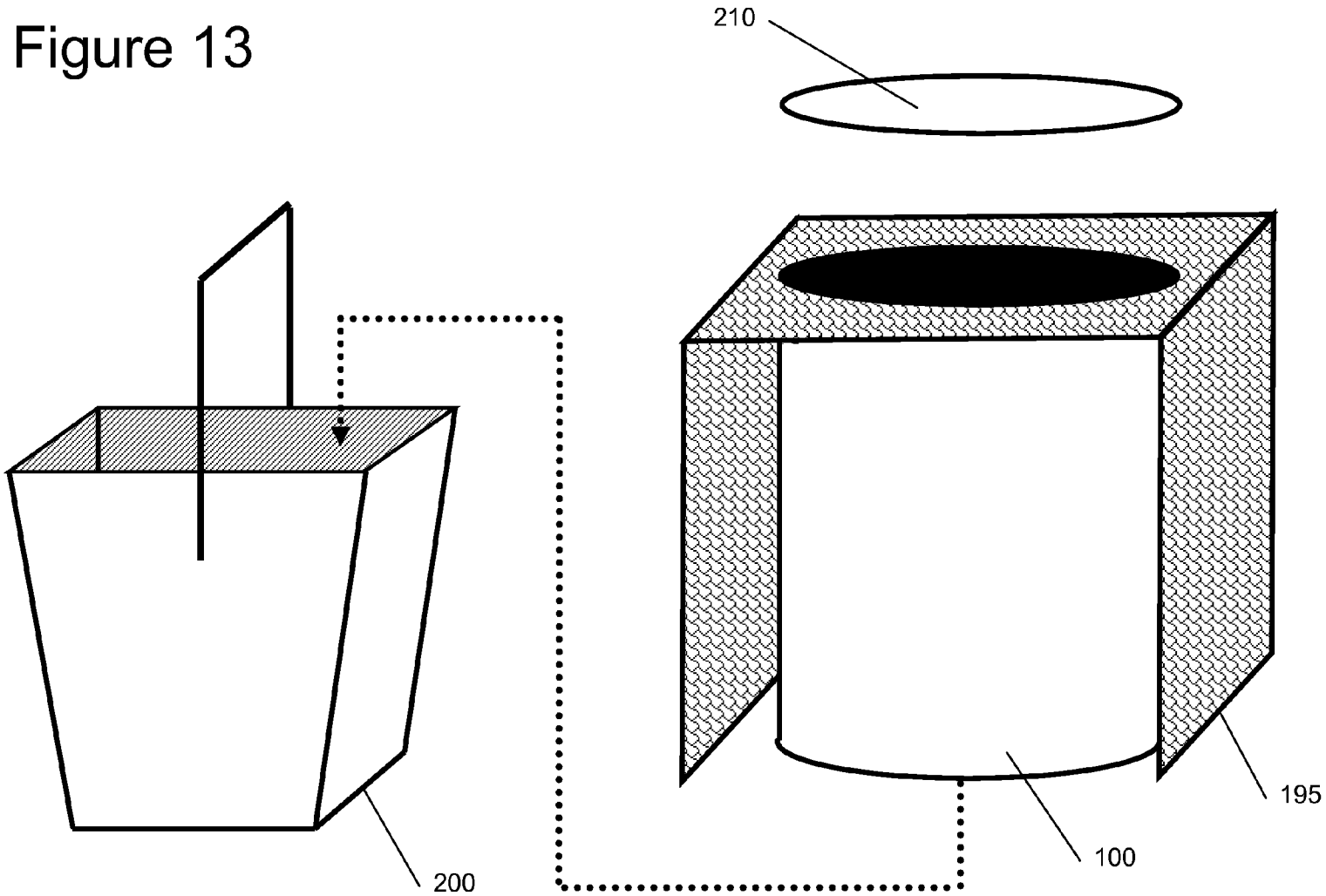
FIG. 13 shows a preferred embodiment of the invention with folded style adaptive structure.

FIG. 13 shows a preferred embodiment described with respect to FIG. 11. FIG. 13 utilizes a folded style adaptive structure 195, which differs from the solid foam adaptive structure 195 shown in FIG. 11 and the ring style adaptive structure 195 shown in FIG. 12.

Internal housing 100 may reside in external housing 200. The exchangeable external housing may be made from repurposed materials, such as beverage or food containers. In FIG. 13, external housing 200 is shown in the shape of a Chinese take-out food box, but a variety of possibilities for external housing 200 exist, as discussed previously. Grill 210, a removable cover for storage compartment 110 (not shown), normally sits on top of internal housing 100.

In FIG. 13, external housing 200, which is box shaped, is significantly larger than internal housing 100, which is cylindrical. The shape of adaptive structure 195 is defined by the external surface of internal housing 100 and the internal surface of external housing 200. Therefore, adaptive structure 195 provides mechanical stability by adapting a cylindrical internal housing 100 to a box shaped external housing 200. In FIG. 13, adaptive structure 195 is a flat piece of material that has been folded, resulting is a folded style adaptive structure, typically made of cardboard, but may be comprised of cardboard, wood, plastic and metal or any combination of materials. Two folds create 3 sections of adaptive structure 195: two sides and a top. In this case, adaptive structure 195 contains a hole on top for interface with internal housing 100 and the two sides interface with external housing 200. The overall shape of internal housing 100 after application of adaptive structure 195 is box-like, adapting the cylindrical surface of internal housing 100 to the larger box-like shape of external housing 200.

Adaptive structure 195 is applied to internal housing 100 prior to insertion into external housing 200. Friction is the preferred means of attaching adaptive structure 195 to internal housing 100, however adhesives, tapes, fasteners, or magnets may also be used. After adaptive structure 195 has been secured to internal housing 100, the entire assembly can be inserted into external housing 200. In this example, friction is the preferred means of securing the assembly inside of external housing 100, however adhesives, tapes, fasteners, or magnets may also be used. Adaptive structure 195 provides the requisite mechanical stability and therefore an external housing addition is not required as it was in FIG. 12.

The shape of adaptive structure 195 and additional adaptive structure 196 shall not limit the scope of the invention and may take any shape that adapts internal housing 100 to external housing 200. Adaptive structure 195 and supporting adaptive structure 196 may contain one or more storage compartments. There is no limit to the number of additional adaptive structures 196 that may be used. To maximize functionality, different styles of adaptive structure 195 may be combined. For example, the empty space between internal housing 100 and folded style adaptive layer 195 in FIG. 13 may be filled with a foam insert similar to the adaptive layer shown in FIG. 11 to maximize mechanical stability.

Many consumer devices already have customizable aspects. Consumer products such as cell phones and global positioning system (GPS) units may include interchangeable faceplates, allowing their users to change the color or theme of the device's appearance. Customization has not yet been applied to portable audio amplifiers. The reader will appreciate that the integrated storage compartment illustrated in the various embodiments of the present invention is useful for transport, storage, and use of the portable amplifier. From the descriptions above, a number of advantages of the embodiments of the present invention become evident:

a. The user no longer loses or searches for accessories such as cords, adapters, etc.
b. The user no longer needs bring multiple items (cord, amplifier, adapter) to listen to music aloud
c. The amplifier's function is not diminished by the storage compartment, nor the interchangeable housing
d. Though the amplifier contains accessories and the cord, it maintains its original look, so users enjoy an element of surprise
e. The consumer can easily change from listening to transport mode,
f. The amplifier can be modified after purchase by the user with a variety of exchangeable housing options, grills, and other accessories to suite user tastes, preferences, and whims.

Embodiments of the present invention allow the user to customize their amplifier after purchase via interchangeable housing options, which may be either manufactured or repurposed, or accessories such as a grill or door. Furthermore, embodiments of the present invention offer a storage compartment in which the user can store a variety of audio accessories such as cords, guitar picks, adapters, batteries, or even an audio source.

It is understood that the above-described embodiments and examples are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claims rather than by the foregoing description. All changes which come within the meaning and range of equivalency of the claims are to be embraced within their scope.

Additionally, although the figures illustrate particular presentations of information, it is understood that the varieties of such that satisfy the limitations of the claims are plethoric.

It is also envisioned that embodiments of the invention may incorporate technologies not yet in existence and may operate in manners not yet contemplated.

Thus, while the present invention has been fully described above with particularity and detail in connection with what is presently deemed to be the most practical and preferred embodiment of the invention, it will be apparent to those of ordinary skill in the art that numerous modifications, including, but not limited to, variations in size, materials, shape, form, function and manner of operation, assembly and use may be made, without departing from the principles and concepts of the invention as series forth in the claims. Further, it is contemplated that an embodiment may be limited to consist of or to consist essentially of one or more of the features, functions, structures, methods described herein.

I claim:

1. A portable audio amplifier comprising:

an internal housing comprising;

at least one storage compartment;

a cover coupled to the storage compartment;

an electronics compartment coupled to the storage compartment containing electronic components, the electronic components being secured to an interior surface of the electronics compartment, the electronic components comprising;

a power source coupled to an amplifier circuit;

a speaker coupled to the amplifier circuit;

a connector or a cable having a connector attached to one end, the connector or an opposite end of the cable coupled to the amplifier circuit allowing the amplifier circuit to be attached to an external audio source;

a barrier or a guard separating the storage compartment from the electronics compartment, wherein the barrier or the guard is attached to an interior surface of the internal housing or the barrier or the guard is an integral part of the internal housing; and, an external housing, wherein the internal housing resides in part or in whole within an interior space of the external housing and is secured to an interior surface of the exterior housing, wherein the external housing is exchangeable and may be removed from the internal housing.

2. The apparatus of claim 1, wherein the power source is contained within the storage compartment, the power source being coupled to the amplifier circuit via a power cable.

3. The apparatus of claim 1, wherein the power source is located external to the internal housing, wherein the power source is coupled to the amplifier circuit via a power cable.

4. The apparatus of claim 2, wherein the power source may be removed from the internal housing.

5. The apparatus of claim 1, wherein the cover may be removed from the storage compartment and may be exchanged with a second cover.

6. The apparatus of claim 1, wherein the exchangeable external housing may be replaced with an alternate external housing.

7. The apparatus of claim 6, wherein the exchangeable external housing is made from repurposed materials.

8. The apparatus of claim 7, wherein the exchangeable external housing is made from a beverage container.

9. The apparatus of claim 7, wherein the exchangeable external housing is made from a food container.

10. The apparatus of claim 1, wherein an adaptive structure is positioned between the external housing and the internal housing, the adaptive structure including a first interface and a second interface, wherein the first interface is in contact with the internal housing and the second interface is in contact with the external housing thereby mechanically securing the internal housing within the external housing.

11. The apparatus of claim 10, wherein the adaptive structure is comprised of a ring style adaptive structure.

12. The apparatus of claim 10, wherein the adaptive structure is comprised of a solid style adaptive structure.

13. The apparatus of claim 10, wherein the adaptive structure is comprised of a folded style adaptive structure.

14. The apparatus of claim 10, wherein the adaptive structure additionally comprises a storage compartment.

15. The apparatus of claim 5, further comprising:

a connection post attached to the cover and a socket attached to the internal housing, the socked accepting and holding the connection post, wherein the cover having the connection post is separated from the socket by removing the connection post from the socket allowing access to the storage compartment.

16. The apparatus of claim 5, further comprising:

a first magnetic element attached to the cover and a second magnetic element attached to a connection post, the first magnetic element attached to the cover couples to the second magnetic element attached to the connection post, wherein one edge of the cover is pushed towards the storage compartment and the opposite edge pulled away from the storage compartment thus removing the cover allowing access to the storage compartment.

17. The apparatus of claim 5, further comprising:

a side swivel pin attached to the cover and a side socket attached to the internal housing that accepts and holds the side swivel pin, wherein the cover is rotated around the axis of the side socket allowing access to the storage compartment.

18. The apparatus of claim 5, further comprising:

swivel pins extending from opposite sides of the cover along a diameter of the cover and side sockets attached to an interior surface if the internal housing, the sockets located such that they hold the ends of the swivel pin, wherein the cover is rotated around the axis of the swivel pins allowing access to the storage compartment.

19. The apparatus of claim 18, wherein the swivel pin is comprised of a single continuous pin attached to the cover and running along the diameter and extending past the perimeter of the cover, or two pins attached to or a integral part of the perimeter of the cover and extending from opposite sides of the cover, the pins located along an axis of the diameter of the cover.

20. The apparatus of claim 5, wherein the cover is attached to a first flange of a hinge and a second flange of the hinge is attached to the internal housing allowing the cover to be rotated around a hinge pin allowing access to the storage compartment.

21. The apparatus of claim 5, further comprising:

a hinged door attached to a first flange of a hinge and a second flange of the hinge attached to the cover, wherein the door is rotated around a hinge pin allowing access to the storage compartment.

22. The apparatus of claim 5, further comprising:

tabs attached to a door, wherein the tabs are positioned within slots located in a side wall of the internal housing, wherein the tabs and door slide as a unit allowing access to the storage compartment.

23. The apparatus of claim 5, further comprising:

the cover having a sliding door and sliding elements attached to the sliding door wherein the sliding elements attached to the door slide within a set of rails, the rails being attached to the cover, allowing access to the storage compartment.

24. The apparatus of claim 1, further comprising;

an upper internal housing containing the storage compartment; and, a lower internal housing coupled to the upper internal housing, the lower internal housing containing the electronics compartment.

25. The apparatus of claim 24, wherein sliding elements are attached to the upper internal housing and rails are attached to the lower internal housing, wherein the sliding elements attached to the upper internal housing slide within the rails attached to the lower internal housing allowing access to the storage compartment.

26. The apparatus of claim 24, wherein the upper internal housing is attached to a first hinge flange of a hinge and a second flange of the hinge is attached to the lower internal housing permitting the upper internal housing to be rotated around a hinge pin allowing access to the storage compartment.

27. The apparatus of claim 24, wherein a side swivel pin is attached to a lower surface of the upper internal housing and a side socket is attached to an upper surface of the lower internal housing the side socket holding the side swivel pin, wherein the upper internal housing is rotated around the axis of the side socket allowing access to the storage compartment.

* * * * *